United States Patent [19]

Tranin et al.

[11] Patent Number: 4,463,681

[45] Date of Patent: Aug. 7, 1984

[54] PROCEDURE OF IGNITING AN EXPLOSIVE DEVICE AND EXPLOSIVE DEVICE THUS OBTAINED

[75] Inventors: Jean-Piere Tranin, Fontenay Aux Roses; Jean-Louis Labourdète, Bourg La Reine, both of France

[73] Assignee: U.S. Philips Corporation, New York, N.Y.

[21] Appl. No.: 383,854

[22] Filed: Jun. 1, 1982

[30] Foreign Application Priority Data

Jun. 3, 1981 [FR] France ..... 81 10994

[51] Int. Cl.[3] ..... F42B 23/04; F42B 23/26

[52] U.S. Cl. ..... 102/424; 102/427

[58] Field of Search ..... 102/427, 428, 424, 401

[56] References Cited

U.S. PATENT DOCUMENTS 3,495,532 2/1970 Roberts et al. ..... 102/401
3,780,653 12/1973 Stinchcomb ..... 102/427

FOREIGN PATENT DOCUMENTS 1451481 7/1966 France .
2319874 2/1977 France .
2332514 6/1977 France ..... 102/424

*Primary Examiner*—Charles T. Jordan
*Attorney, Agent, or Firm*—Robert T. Mayer; Bernard Franzblau

[57] ABSTRACT

A procedure for igniting an explosive device, particularly an anti-tank influence mine acting on the full width of a vehicle, comprising a formed charge (1) and a clearing charge (3). The procedure consists in inhibiting the ignition of the clearing charge during the passage of a heavy, predominantly metallic object in contact with the ground straight over the explosive device.

11 Claims, 5 Drawing Figures

PROCEDURE OF IGNITING AN EXPLOSIVE DEVICE AND EXPLOSIVE DEVICE THUS OBTAINED

The invention relates to a procedure for igniting an explosive device, more specifically a mine having a formed charge, comprising a clearing charge, and safety means for its firing.

The invention also relates to the explosive device obtained by means of the above-mentioned procedure, which explosive device may particularly be an influence anti-tank mine intended to be buried, comprising on the one hand a clearing charge provided with an electric igniter $I_1$ which is supplied from an ignition circuit and on the other hand a formed charge as the main charge.

The explosive devices to which the invention relates are preferably "full shots", that is to say devices incorporating the charge and the detonator with its ignition means. This characteristic technique imposes requirements on the electrical and/or mechanical conditions to the effect that untimely or accidental ignition of the pyrotechnic artifices which contain the priming explosive will be without effect on the functioning of the main charge. The present invention has for its object to increase the efficiency of the mine by acting on its igniting device and although it does not directly relate to the security problems as regards the firing of the mine, the invention remains compatible with the security arrangements for the ignition.

Hereinafter, by way of example, an anti-tank mine will be described which can also become operative when a wheeled vehicle passes over it. This mine is buried at a depth of the order of 15 cm. It comprises a formed charge, that is to say a flot or a hollow charge, with directional action, with a conical metallic cover on top. On top of this cover there is a clearing charge which itself is closed by a lid or a slightly elastic metallic cover or lid which is placed on the top portion of the mine at the time it is buried. Such a mine is partly described in Applicant's French Patent Specification No. 2,319,874. The known manner of triggering this mine, for example, the so-called HPD-mine is effected in two stages, namely triggering the clearing charge which blows away the surrounding matter on top of the mine, thereafter, after a delay of approximately 0.1 second, the main charge is triggered. This prior art arrangement makes it possible to benefit fully from the directional effect of the charge even if it is buried in the ground and consequently to obtain the maximum efficiency when the charge acts on the wheels or on the chains of the vehicle to be destroyed.

Such a mine is an influence mine commonly referred to as a "full width" mine, which can act on the full width of the vehicle, that is to say both on the chains or on the wheels of the vehicle and between them. The known arrangement and sequence of ignition described above have for their result that when a charge of this type acts on the chain of a tank or the wheel of a vehicle, the chain either breaks, which is the result aimed at or a hole is made in the chain (the wheel) in certain unfavourable conditions and in the latter case the tank or the vehicle has not totally lost its mobility. It has been demonstrated that this drawback is in the first place the result of the action of the clearing charge. The invention has for its object to increase the efficiency of the buried mine when the chain of a tank or the wheel of a vehicle passes over the mine.

While fully maintaining the advantages of the prior art, this object is accomplished by the fact that the procedure described in the opening paragraph is characterized in that the passage of a heavy, predominantly metallic object in contact with the ground straight over the explosive device inhibits the ignition of the clearing charge and by the fact that the explosive device mentioned in the second paragraph of the description is characterized in that it comprises inhibiting means which during the passage of a heavy predominantly metallic object straight over the mine prevents the said ignitor $I_1$ from becoming operative at least during the time T, starting at the instant $t_1$, of the passage of the said heavy metallic object.

To basic idea of the invention is to fully profit from the effect of confinement obtained when a pressure is exercised on the layer of earth which covers the mine by having the main charge function not as a formed charge, with directional action which acquires its maximum efficiency from a certain distance, but as an explosive for conventional use of which above all the shattering effect due to the shock wave is made use of.

Experiments have proved that the explosion of the mine in accordance with the invention under the chain of a tank abruptly shatters this chain.

The following description which is given by way of nonlimitative example with reference to the accompanying drawings will make it clear how the invention can be put into effect.

FIG. 1*a* is the circuit diagram of a first embodiment of the explosive device in accordance with the invention in a cut-away side elevational view and with a rotation through 90° between the upper and the lower portions of the diagram.

FIG. 1*b* shows a variation of the first embodiment.

Figure 1A:
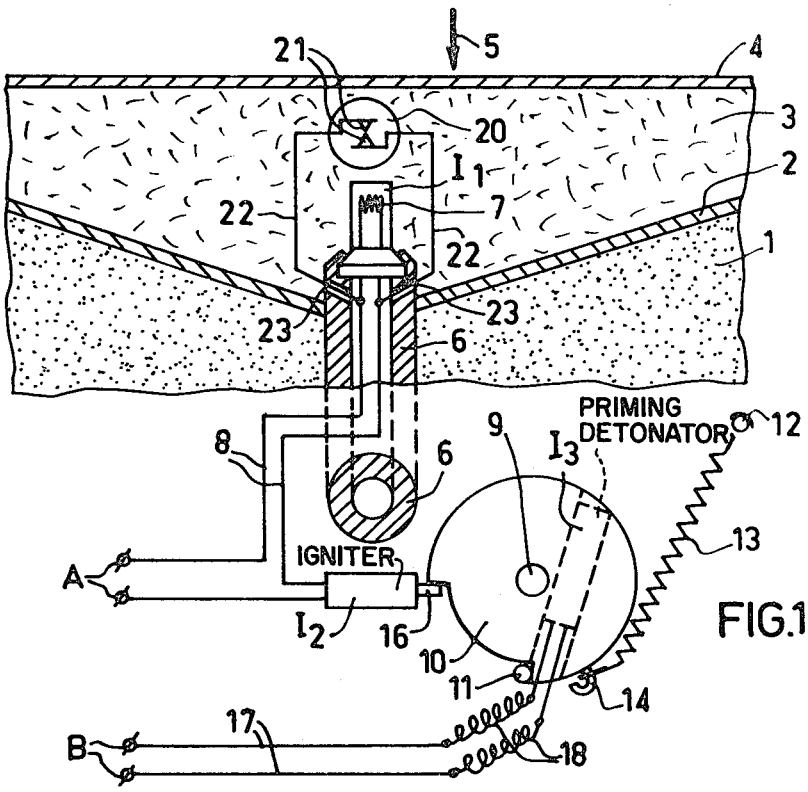
Figure 1B:
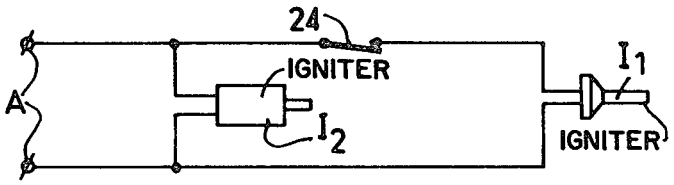
Figure 2:
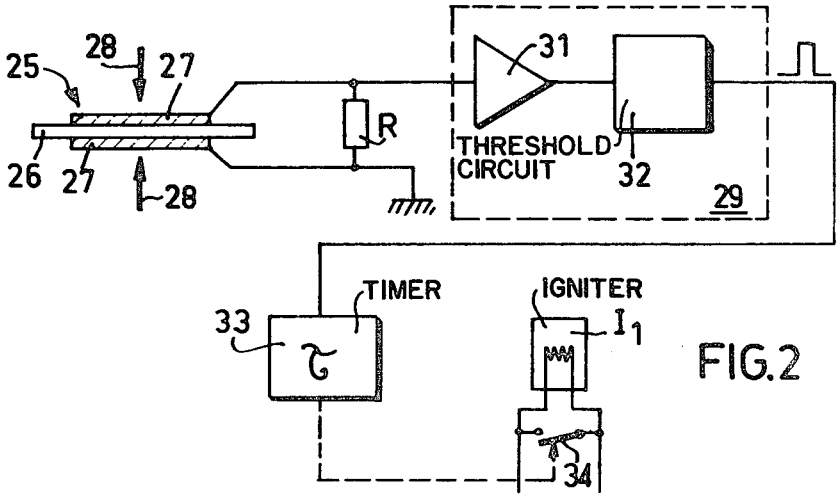
FIG. 2 shows in detail the inhibiting means for a second embodiment in accordance with the invention.

The explosive device shown in FIG. 1 comprises in its upper portion which is shown in a cut-away side elevational view a formed charge 1 which in its lower portion incorporates a pyrotechnical relay, not shown, and has a conical cover 2. A clearing charge 3 is closed by a cover or an upper lid 4 and is positioned on top of this conical cover. The lid 4 is in the form of a thin metallic sheet which has a certain degree of flexibility in the direction indicated in the drawing by arrow 5. A tubular envelope 6 which is shown with a rotation through 90° between the upper and lower portions of FIG. 1 has at its upper end an axial bore which can contain an igniter $I_1$ which closes an electric resistor 7 which is surrounded by a small powder charge. The connecting wires 8 of the igniter $I_1$ lead through a longitudinal slot, not shown, to the interior of the tube 6. Attached to the lower portion of the tube 6 is a metal plate, not shown, below which the different elements shown in the lower portion of FIG. 2 are fixed. These elements are in particular an axle 9 around which a rotor 10 which cannot move in the axial direction can rotate, an electrically controlled igniter $I_2$, a snap 11 and a pin 12 to which a spring is anchored. The rotor 10 is provided with a cylindrical bore in which an electrically controlled primer detonator $I_3$ is accomodated which is fixed in known manner in its seat. A draw spring 13 which is stretched between the pin 12 and a hook 14 which forms one whole with the rotor 10 loads the rotor 10 in the direct geometrical sense. The igniter $I_2$ is provided with a pin 16 which is preferably made of a plastics material and which keeps the rotor 10 in the so-called safety position. When the igniter $I_2$ is ignited, the pin 16 is destroyed and allows the rotor to rotate as far as the fixed wedge 11, under the action of the draw spring 13. The rotor 10 is then in its second position commonly referred to as the armed position, not shown, in which the primer detonator is in intimate contact with the pyrotechnic priming relay of the main charge. This relay, not shown, is provided in the lower portion of the principal charge and in the axial bore of the tube 6. In what is commonly referred to as its armed position the priming detonator $I_3$ is capable of inducing a foolproof explosion of the main charge. If in contrast therewith, the priming detonator $I_3$ is ignited in its safety position, which is the position shown in FIG. 1, this ignition remains without effect on the relay because of its remoteness therefrom, and on the main charge 1 owing to the presence of the metallic plate arranged between the rotor 10 and the charge 1. The priming detonator $I_3$ is supplied with power by the conductors 17, a portion 18 of which is expandable to allow the rotation of the rotor 10 under the action of the spring 13. The ignition resistors of the igniters $I_1$ and $I_2$ are arranged in series and are supplied with power from the terminals A and the igniting resistor of the priming detonator $I_3$ is supplied with power from the terminals B. The portion of the mine described in the foregoing with reference to FIG. 1 corresponds to the prior art and operates as follows:

An electric and electronic device which will be described in greater detail hereinafter with reference to FIGS. 3 and 4 generates at the terminals A at an instant $t_2$ during the passage of a tank or a wheeled vehicle over the mine a first electrical pulse, for example a voltage pulse having an amplitude of 4 V and a duration of 10 ms, which induces simultaneously the explosion of the clearing charge 3, which blows away the cover plate 4 and the earth above it, and the destruction of the pin 16 which causes the rotor 10 to move from its safety position to the sure armed position. The electronic device is of such a construction that 100 ms after the instant $t_2$ a second pulse similar to the first pulse which appeared in position A appears at the terminals B. The priming detonator $I_3$ then explodes and the explosion is communicated to the main charge by means of the relay, not shown. This mode of operation remains the same over the full width of the tank or the wheeled vehicle, that is to say that the mine explodes between chains, between wheels or under a wheel or a chain.

According to the invention, a push-button switch 20 is accomodated in the clearing charge, the lid 4 being made to bear on said push-button switch. The switch 20 has electrical contacts 21 which are normally open. In the presence of a heavy object on the layer of earth covering the mine the pressure thus exercised is transmitted, via the earth, and causes the lid 4 which behaves as a flexible membrane to bend inwards. The push-button switch 20 is depressed and the contacts 21 close. As the contacts 21 are connected by the conductors 22 to the connecting wires 8 of the igniter $I_1$, the latter is short-circuited. If during closure of the contacts 21 an electrical pulse as defined in the foregoing appears at A, only an insignificant current flows through the resistor 7 which is by-passed by the conductors 22. If in contrast therewith the igniter $I_2$ operates, a current which is substantially equal to or twice the current existing during its operation in accordance with the prior art flows through the resistor of the said igniter, this operation being followed 0.1 second later by the operation of the priming detonator $I_3$ in the armed position, which induces the explosion of the main charge 1 while the clearing charge has not previously exploded. During the explosion of the mine the clearing charge which is in the form of a black powder is simply dispersed and all this is effected in a way as if this clearing charge were not present in the mine, because of the fact that its explosion requires a period of time of the order of some ms while the explosion of the main charge is typically less than 1 ms. The confinement effect being maintained thus and increasing owing to the presence of the heavy object over the mine until the explosion of the main charge 1, this main charge is deflected and no longer acts as a concentrated charge, the efficiency of the explosion being rather obtained by the shock waves. FIG. 1 shows the conductors 22 which lead through the walls of the tubular envelope 6 via the openings 23. These openings are provided with a sealing means (not shown) to prevent the powder forming the clearing charge 3 from penetrating into the tubular envelope 6. On the other hand it is possible to control the stroke of the push-button 20 and/or its distance to the membrane so that the switch closes above a certain predetermined pressure threshold. It should be noted that, without departing from the scope of the invention, the same result would be obtained by using a switch which is normally closed when not operated and which opens under the action of the membrane. $I_1$ and $I_2$ must then be arranged in parallel and the igniter must be arranged in series with $I_1$. The circuit diagram of this variation is shown in FIG. 1*b* in which the push-button switch is denoted by reference numeral 24. This first embodiment of the invention and its variation are advantageous to the extent that the igniter $I_1$ is inhibited during and only during the presence of a heavy object (in general a predominantly metallic object) straight over the mine, but the embodiment may have some drawbacks. According to the nature of the ground which is more or less capable of being compressed and according to the variable pressure which may be exercised by a vehicle it may prove to be difficult to adjust the sensitivity of the push-button switch 20. On the other hand, a mine buried in the ground exercises already a residual pressure resulting from its environment, which pressure is not negligible, particularly in a period of frost. It should at any rate be noted that an unwanted operation of the push-button switch with respect to the above-described desired operation is not harmful to the safety devices for the ignition of the mine.

The contemporary mines are provided with an influence igniter capable of triggering the charge under the full width of the vehicle (tank or wheeled vehicle). These igniters are, for example, provided with magnetic, seismic, acoustic sensors with mutual induction or other types of sensors which ensure triggering of the charge. In order to improve the ability to discriminate between the target vehicles and any other disturbances, at least two sensors (detectors) of different types are present in the mine. On the other hand, the majority of these sensors produce electric signals which are different according as the mine is located between or under the chains (wheels, respectively). In the further course of the description this type of sensor is designated as a discriminating sensor. This is particularly the case for seismic sensors and for magnetic sensors whose amplitude is higher when the chain (the wheel) passes over the mine. For the magnetic sensors in particular this property is due to the distance to the target. For a mine which is buried at a standard depth of 15 cm, the distance between the mine and the bottom of a tank is approximately 65 cm, while the distance between the mine and the chain is 15 cm. In addition, the ability of discrimination is increased by the fact that the law of variation of the signal as a function of the distance d is a law of $1/d^2$. In the case where another influence than a magnetic influence is involved, the discrimination between the chain and the bottom of the tank may be based on other characteristics of the signal received by the sensors, for example, the difference in the propagation times for a sensor of the radar or the ultrasonic types.

Figure 3:
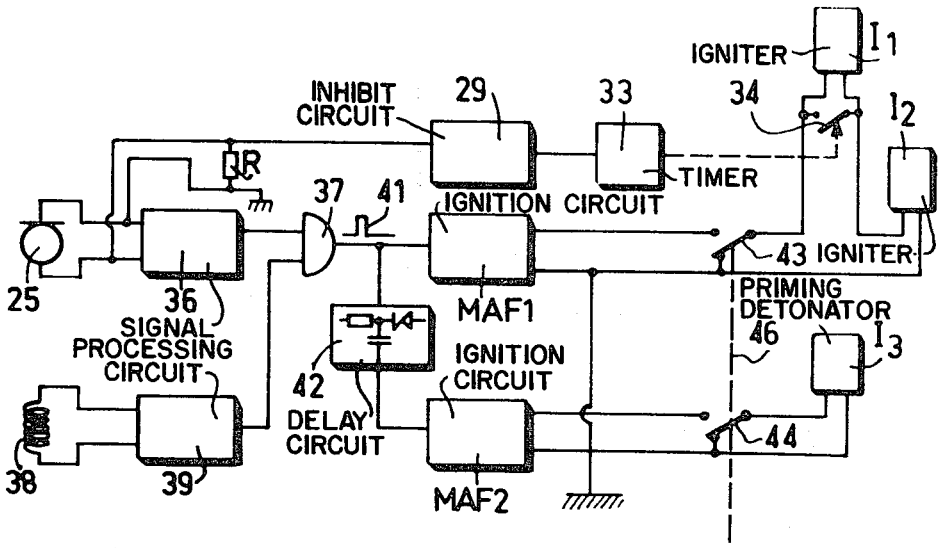
FIG. 3 is the block schematic circuit diagram of the ignition device in accordance with the second embodiment.
Figure 4:
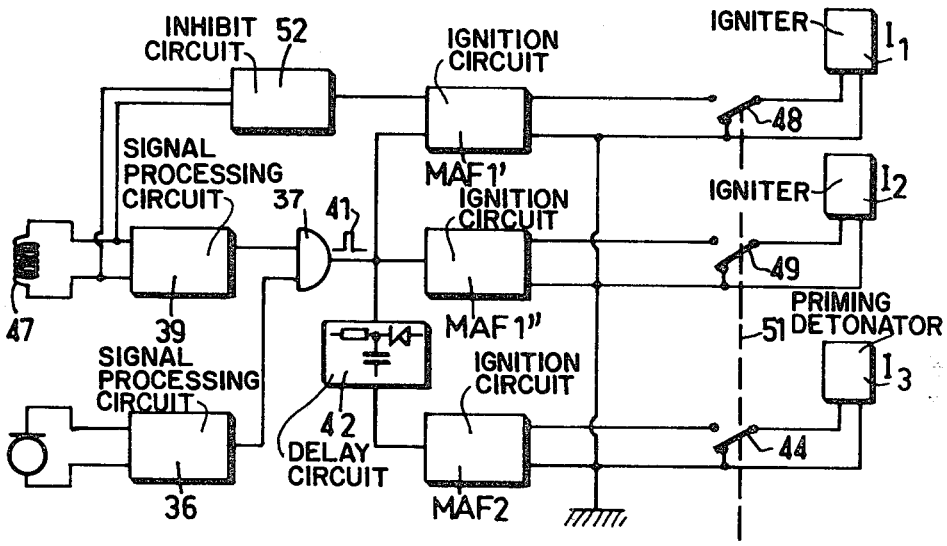
FIG. 4 is the block schematic circuit diagram of the igniting device in accordance with a third embodiment.

The presence of a discriminating sensor in the mine may be used to realize other embodiments of the invention as such, for example, described hereafter with reference to the FIGS. 2, 3 and 4.

The FIGS. 2 and 3 relate to a second embodiment of the invention.

FIG. 2 is the circuit diagram of a pressure sensor 25 in the form of a resilient membrane (not shown) which is coupled to a pressure or displacement transducer formed by a layer 26 of a piezoelectric material, for example barium titanate covered by metallic layers 27 which function as electrodes. This sensor has the property of converting the pressure or displacement variations, shown symbolically by the arrows 28, into an electric signal which is approximately proportional thereto between the electrodes 27. In this case use is not made of a static pressure as in the first embodiment but of pressure variations, which variations might give rise to active or inhibiting pyrotechnic triggerings in the mine, even if they have a low amplitude. According to the invention, the electrodes of the sensor 25 are connected to inhibiting means 29 via a differentiating circuit formed by the interelectrode capacitance of the sensor and a resistor R arranged in parallel therewith. The inhibiting means 29 is formed by an alternating signal amplifier 31, which is followed by a threshold circuit 32 of a known type, which has for its function to supply a pulse each time the electrical input quantity exceeds a predetermined threshold value. In accordance with the second embodiment the output signal of the inhibiting means 29 is transmitted to a timer element 33 which converts each pulse it receives into a square-wave voltage or current of a predetermined duration $\tau$. The output signal of the timer 33 controls a switch 34 which is closed during the period of the square-wave so as to short-circuit the igniter $I_1$ and is open in the absence of the square-wave. The timer 33 is, for example, a monostable circuit controlled by the ascending or descending edge and the switch 34 is a field effect transistor controlled via its gate. A pulse is produced substantially at the instant $t_1$ which marks the beginning of the passage of the chain or the wheel. The time $\tau$, which also starts substantially at the instant $t_1$ is determined in such a manner that it is longer than the transmit time of the vehicle or the tank. $\tau$ is, for example, equal to 10s.

FIG. 3 is the block schematic circuit diagram of the ignition device in accordance with the second embodiment. A discriminator sensor, for example the seismic sensor 25, has its terminals connected to a processing circuit 36 for the seismic signal, the output of this processing circuit being applied to an AND-gate circuit 37. A second sensor, for example a magnetic sensor 38, has its terminals connected to a processing circuit 39 for the magnetic signal, the output of this processing circuit being applied to a second input of the AND-gate circuit 37. In known manner, the circuits 36 and 39 comprise amplifiers, filters, threshold circuits and integrators. During the presence of a vehicle over the mine the electric signals transmitted at 25 and 38 are processed in circuits 36 and in 39 after a predetermined time delay of the order of 0.5 s after the instant $t_1$, a pulse-shaped signals appear at the output of the circuits 36 and 39. This results in a triggering pulse 41 at the output of the AND-gate circuit 37. Pulse 41 is directly applied to a first ignition circuit MAF1 which controls the ignition of the series-arranged igniters $I_1$ and $I_2$ and to a second ignition circuit MAF2 which controls the ignition of the priming detonator $I_3$ via a delay circuit 42, which is predominantly formed by, for example, a resistor and a Zener-diode whose junction point is connected to a capacitor. The circuit 42 delays the pulse 41 by approximately 0.1 s. In known manner, the circuits MAF1 and MAF2 comprise transistors and ignition capacitors and convert the pulse 41 they receive into a calibrated pulse having an amplitude equal to 4 V and a duration equal to approximately 10 ms. FIG. 3 also shows the electric safety means for storage of the mine, these means being formed by two-position switches with common manual control which are symbolized by the broken line 46. During storage of the mine, the switches 43 and 44 are in the position shown in the Figure so that all the conductors of the igniters $I_1$, $I_2$, $I_3$ are connected to ground, electrically isolated from the ignition circuits MAF1 and MAF2. During positioning of the mine in the ground, the operator operates the bar 46 which adjusts the switches 43 and 44 to the second, active position, not shown in the Figure. The arrangement in accordance with the invention, which has already been described with reference to FIG. 2, is shown in the upper portion of FIG. 3 at 29, 33 and 34.

FIG. 4 shows a third embodiment of the invention in which the same reference numerals represent the same components as in FIG. 3 and in which a magnetic sensor 47, for example of the type described in French Patent Specification No. 1,451,481 is used as a discriminating sensor. This third embodiment differs from the embodiment shown in FIG. 3 in that it comprises three igniting circuits and, particularly, an ignition circuit MAF1' of the igniter $I_1$ and an igniting circuit MAF1" of the igniter $I_2$, which are both connected to the output of the AND-gate circuit 37. Similarly, the electric safety means is formed by three two-position switches 44,48 and 49 with a common manual control 51. In accordance with the invention, the inhibiting means 52 convert the variations in the electric field they receive from the magnetic sensors 47 into a pulse which is transmitted to the circuit MAF1', and which suppresses in the latter, by all known means, either the pulse 41 which is subsequently received at the instant $t_1$ at the other input of the circuit MAF1' or the effect of this pulse, the duration of this suppression being equal to the previously defined duration.

It should be noted that in all of the above-described embodiments of the invention an inadvertent operation of the inhibiting means such as 20, 29, 52, which is not accompanied by the explosion of the mine does not change in any respect a proper subsequent operation of the mine.

We claim:

1. An explosive anti-tank influence mine device for burial in the ground comprising, a clearing charge having an electric igniter $I_1$ supplied with power from an igniting circuit, a formed charge as its main charge, inhibiting means which, during the passage of a predominantly metallic heavy object straight over the mine prevents the said igniter $I_1$ from functioning at least during a given period of time starting at an instant $t_1$ at which the passage of the said heavy metallic object is detected.

2. An explosive device as claimed in claim 1, characterized in that the said inhibiting means comprise a push-button switch accommodated in the clearing charge and having a change of state induced by the passage of the said heavy metallic object in contact with the ground straight over the explosive device.

3. An explosive device as claimed in claim 1 comprising an influence igniter incorporating sensors which are responsive to physical effects of a different nature and including at least a discriminating sensor which produces different electric signals according as the said heavy metallic object in contact with the ground passes either straight over the mine or in the immediate vicinity of the mine and that the said inhibiting means receive the said electric signals from the said discriminating sensor and produce an electric pulse substantially at the instant $t_1$ only when the said heavy metallic object passes straight over the mine.

4. An explosive device as claimed in claim 1 characterized in that the said inhibiting means induce a short-circuiting of the igniter $I_1$ at least during said given period of time.

5. An explosive device as claimed in claim 3 comprising an ignition circuit for the igniter $I_1$ wherein said pulse is applied to the said ignition circuit to prevent it from operating during said given period of time.

6. An explosive land mine device having a formed charge including a clearing charge and safety means for its firing, detection means for the detection of the passage of a heavy predominantly metallic object in direct contact with the ground straight over the explosive device, and inhibiting means coupled to the detection means so as to prevent exclusively the ignition of the clearing charge when the detection means detects said object's passage.

7. An anti-tank influence mine device as claimed in claim 6 for burial in the ground wherein the device comprises timing means for inhibiting the ignition of the clearing charge for a predetermined time after the detection of said object's passage by the detection means.

8. An explosive device as claimed in claim 7 wherein said detection means and inhibiting means comprise a push-button switch accommodated in the clearing charge, a change of state of the switch being induced by the passage of the said heavy metallic object in contact with the ground straight over the explosive device.

9. An explosive device as claimed in claim 7 comprising an influence igniter incorporating sensors which are responsive to physical effects of a different nature, wherein the detecting means comprise at least a discriminating sensor which produces an electric signal when said heavy metallic object in contact with the ground passes either straight over the mine or in the immediate vicinity of the mine and wherein said inhibiting means receive the said electric signals from said discriminating sensor to inhibit the ignition of the clearance charge.

10. An explosive device as claimed in claim 7 wherein the clearing charge is provided with an electric igniter and said inhibiting means induce a short-circuit of the electric igniter at least during the said predetermined time.

11. An explosive device as claimed in claim 9 further comprising an electric igniter for the clearing charge and wherein said inhibiting means produces a short-circuit of the igniter at least during said predetermined time.

* * * * *